United States Patent [19]

Correa

[11] Patent Number: 4,938,466

[45] Date of Patent: Jul. 3, 1990

[54] CLUTCH ASSEMBLY FOR A VACUUM SIGNATURE FEEDING DEVICE IN A PACKER BOX

[75] Inventor: Salvador Correa, Middletown, Conn.

[73] Assignee: R. R. Donnelley & Sons Company, Chicago, Ill.

[21] Appl. No.: 361,237

[22] Filed: Jun. 5, 1989

[51] Int. Cl.[5] ..... B65H 3/08

[52] U.S. Cl. ..... 271/107; 271/100; 192/67 P; 192/85 C

[58] Field of Search ..... 271/100, 107; 192/67 P, 192/85 C

[56] References Cited

U.S. PATENT DOCUMENTS

| | | | |
|---|---|---|---|
| 2,678,485 | 5/1954 | Browne | 192/85 C X |
| 4,504,094 | 3/1985 | Burrows | 192/67 P X |
| 4,714,242 | 12/1987 | Selak | 271/107 X |

*Primary Examiner*—Michael S. Huppert

*Assistant Examiner*—Kenneth DeRosa

*Attorney, Agent, or Firm*—Wood, Phillips, Mason, Recktenwald & VanSanten

[57] ABSTRACT

A clutch assembly for a vacuum signature feeding device in a packer box. The clutch assembly includes a pair of disks disposed within a bore in a housing for selective driving engagement therebetween. It also includes an oscillatory motion transmitting shaft for engaging and disengaging the disk only in a preselected angular orientation therebetween for imparting oscillatory motion to one of the disks and transmitting oscillatory motion from the other of the disk when the disks are engaged. The clutch assembly is also adapted to operatively transmit the oscillatory motion to the vacuum signature feeding device. With this arrangement, reciprocating movement of the vacuum signature feeding device can be selectively interrupted without vacuum interruption.

32 Claims, 3 Drawing Sheets

CLUTCH ASSEMBLY FOR A VACUUM SIGNATURE FEEDING DEVICE IN A PACKER BOX

FIELD OF THE INVENTION

The present invention is directed to a clutch assembly and, more particularly, a clutch assembly for a vacuum signature feeding device in a packer box.

BACKGROUND OF THE INVENTION

As is well known in the art, books are comprised of signatures which are folded sheets bearing the printed matter. The individual signatures which comprise the book or magazine are fed from hoppers or pockets which are an integral component of a packer box. Usually, the signatures for each book are collected one atop another after which they are joined into a book by stitching or the like.

In the usual case, a binding line will have a large number of packer boxes with a variety of different signatures. Selected binding on the basis of demographics has now become an important requirement whereby a customized book may be bound for each individual subscriber by means of demographic controls through a control tape or other computer software. In this manner, it is possible to limit advertising to a demographically selected constituency to ensure maximum impact for the advertiser in a given book.

For this reason, it is necessary to exert control over each packer box. Thus, in a given run of a binding line, there must be constant enabling and disabling of vacuum signature feeding devices from any group of packer boxes. For this purpose, there have been two principal means for controlling the operation of a packer box.

Specifically, there are devices in the art whereby a solenoid is used to lock an arm of a vacuum signature feeding device in a position of inoperability. Thus, even though the vacuum control continues to function on an intermittent basis in time with the operation of the binding line, the vacuum signature feeding device is prohibited from reciprocating between the associated hopper or pocket where the signatures are stacked and, e.g., the saddle chain or conveyor. In other instances, the vacuum signature feeding device is temporarily disabled by very simply interrupting vacuum thereto.

In the latter case, it has been found that the stack of signatures is loosened by reason of the repeated contact of the device with the signatures in the stack. Thus, when the vacuum is again resumed, the vacuum signature feeding device will have a tendency to pull several of the loose signatures toward the saddle chain or conveyor which is undesirable inasmuch as it may cause a jam in the packer box or a defective book. For this reason, vacuum interruption has been found to be less than entirely satisfactory in the binding line field.

As for locking the vacuum signature feeding device in position with a solenoid, this has found somewhat more wide ranging acceptability. Nevertheless, the mechanical assemblies required for operation of such devices and their associated locking arms and the like have been complex, expensive and less than entirely effective inasmuch as timing can be adversely affected. In this connection, the device is typically disabled by means such as lifting a cam follower from contact with a cam.

The present invention is directed to overcoming the above stated problems and accomplishing the resulting objectives.

SUMMARY OF THE INVENTION

Accordingly, the present invention is directed to a clutch assembly for a vacuum signature feeding device in a packer box. The clutch assembly includes a pair of disks disposed within a bore in a housing for selective driving engagement therebetween. It also includes means for engaging and disengaging the disks only in a single preselected angular orientation therebetween together with means for imparting oscillatory motion to one of the disks and means for transmitting oscillatory motion from the other of the disks when the disks are engaged. The clutch assembly is such that the oscillatory motion transmitting means is operatively associated with the vacuum signature feeding device. With this arrangement, the clutch assembly operates in a most effective and efficient manner in a conventional packer box.

In a preferred embodiment, the disk engaging and disengaging means includes an oscillatory motion transmitting shaft extending axially from one end of the housing together with means for transmitting axial movement to the oscillatory motion transmitting shaft. As a result, the axial movement transmitting means may advantageously utilize an air actuator having an axially driven piston operably associated with the oscillatory motion transmitting shaft through a yoke. More specifically, the oscillatory motion transmitting shaft preferably has a bearing element externally of the housing whereby the yoke cooperates with the bearing element to transmit axial movement to the oscillatory movement transmitting shaft.

Further, the disk engaging and disengaging means preferably includes a radially extending thrust pin integral with the oscillatory motion transmitting shaft within the housing for movement therewith. The radially extending thrust pin is advantageously axially moveable with the oscillatory motion transmitting shaft from a first position where the disks are engaged to a second position where the disks are disengaged. With this arrangement, the housing preferably includes a clutch polarizing portion having an internal wall with a restricted opening adapted to admit the radially extending thrust pin into the clutch polarizing portion only in the single preselected angular orientation between the disks.

In a highly preferred embodiment, the oscillatory motion imparting means includes a radially extending clutch lever integral with the oscillatory motion transmitting shaft externally of the housing. The radially extending clutch lever is preferably operably associated with a cam driven by the packer box for imparting oscillatory motion to one of the disks through the oscillatory motion transmitting shaft. In this connection, one of the disks is advantageously a male disk with the other of the disks being a female disk. The male disk preferably includes an engagement pin and the female disk includes an engagement opening receiving the engagement pin only in the preselected angular orientation between the disks. As a result, the vacuum signature feeding device can be selectively interrupted from reciprocating movement in a manner not requiring vacuum interruption.

As will be appreciated, the oscillatory motion transmitting means advantageously includes drive means for imparting reciprocating rotation movement to the vacuum signature feeding device when the male and female disks are engaged. Preferably, the clutch assembly also includes spring means for maintaining the vacuum signature feeding device against a stack of signatures when the male and female disks are disengaged. Still more specifically, the spring means preferably includes a spring operably associated with the oscillatory motion transmitting disk and the vacuum signature feeding device for biasing the vacuum signature feeding device toward the stack of signatures.

Other objects, advantages and features of the present invention will become apparent from a consideration of the following specification taken in conjunction with the accompanying drawings.

DETAILED DESCRIPTION OF THE PREFERRED EMBODIMENT

Figure 1:
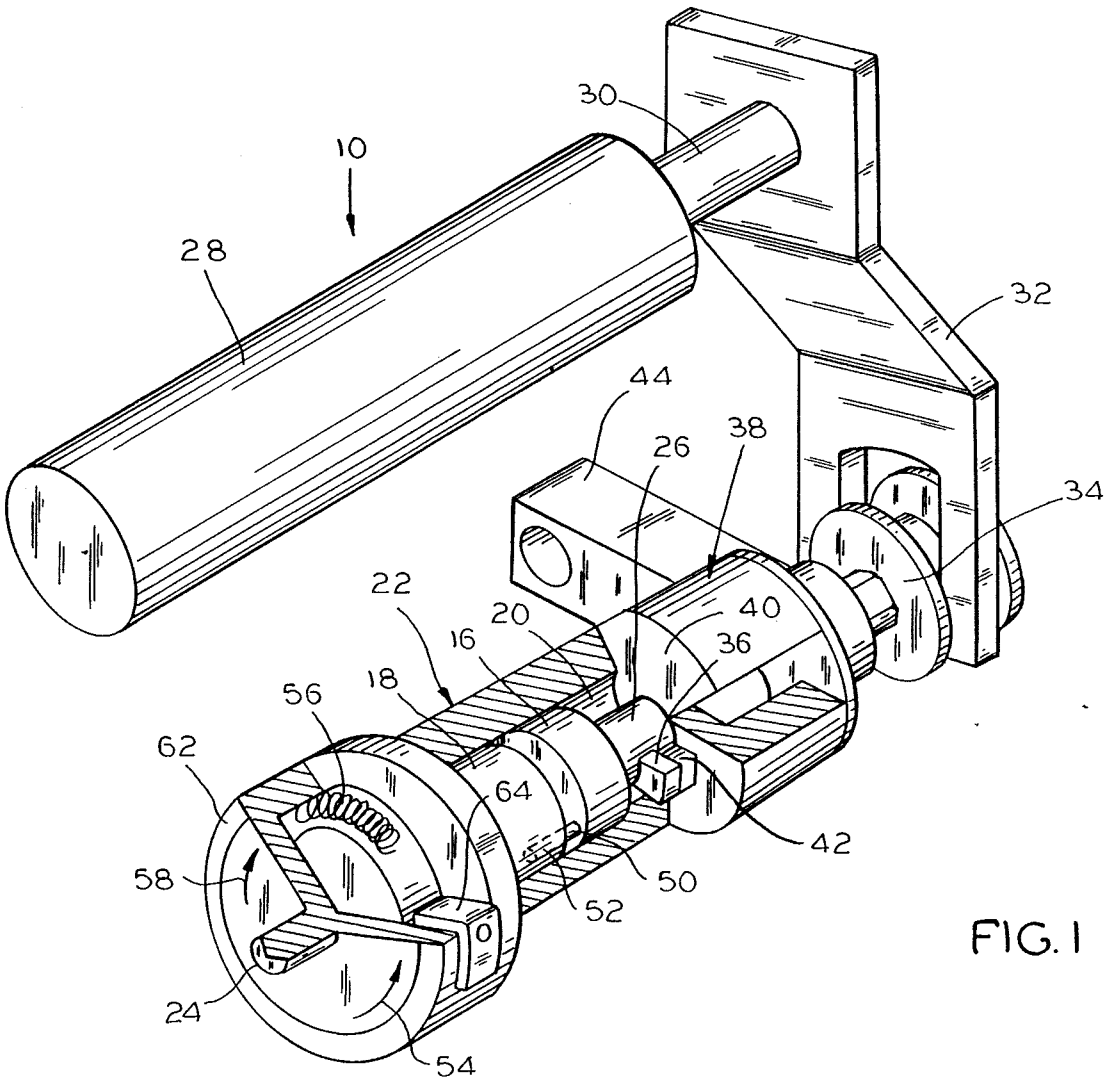
FIG. 1 is a perspective view of a clutch assembly for a vacuum signature feeding device in a packer box in accordance with the present invention.
Figure 2:
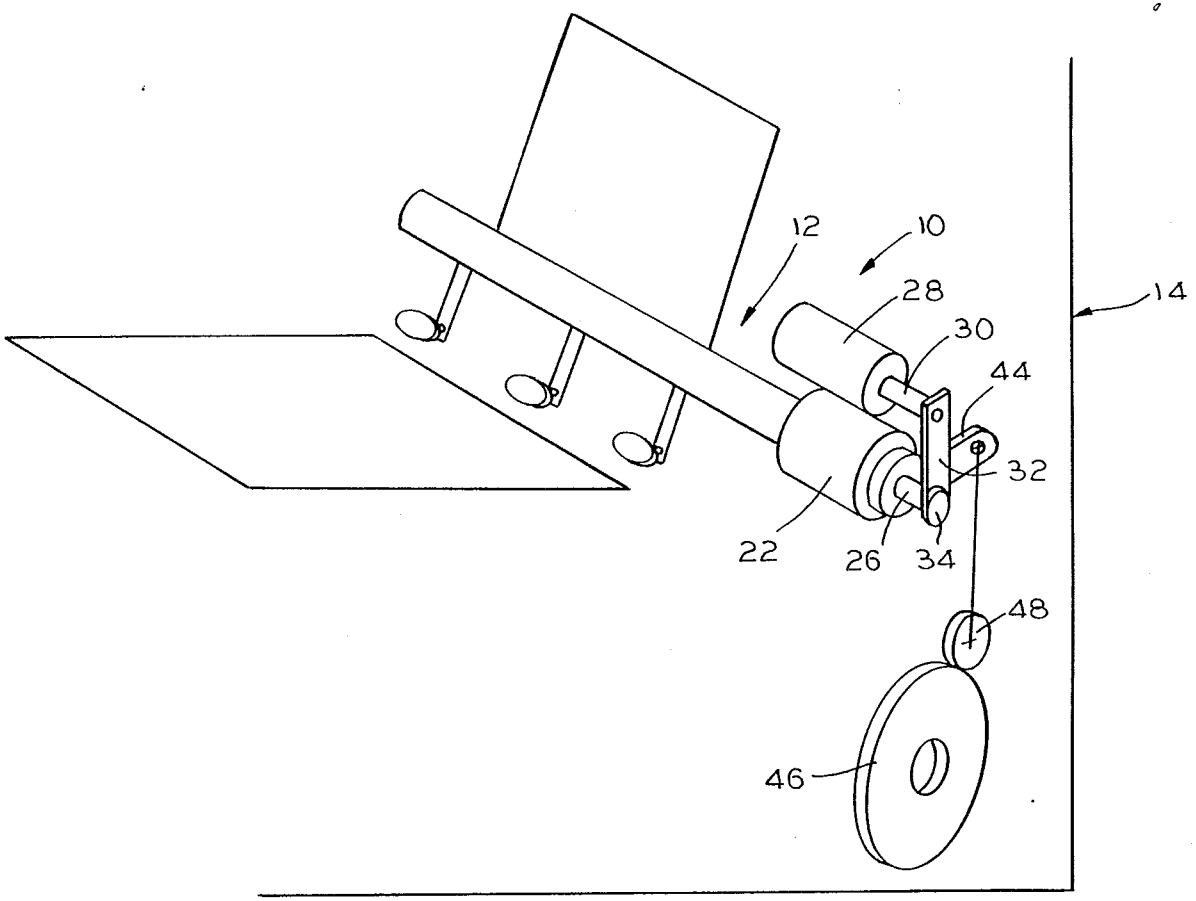
FIG. 2 is a perspective view, partially schematic, illustrating a packer box having a vacuum signature feeding device controlled by the clutch assembly of FIG. 1.

Referring to the drawings, and first to FIGS. 1 and 2, the reference numeral 10 designates generally a clutch assembly for a vacuum signature feeding device 12 in a schematically illustrated packer box 14. The clutch assembly 10 includes a pair of disks 16 and 18 disposed within a bore 20 in a housing 22 for selective driving engagement therebetween. It also includes means for engaging and disengaging the disks 16 and 18 only in a single preselected angular orientation therebetween and means for imparting oscillatory motion to one of the disks 16 together with means for transmitting oscillatory motion from the other of the disks 18 when they are engaged. The clutch assembly 10 further is such that the oscillatory motion transmitting means is operatively associated with the vacuum signature feeding device 12 through means such as a stud 24. With this basic arrangement, the clutch assembly 10 is adapted to selectively interrupt reciprocating movement of the vacuum signature feeding device 12 in a preselected position without vacuum interruption.

Still referring to FIG. 1, the disk engaging and disengaging means includes an oscillatory motion transmitting shaft 26 extending axially from one end of the housing 22 together with means for transmitting axial movement to the oscillatory motion transmitting shaft 26. More specifically, the axial movement transmitting means includes an air actuator 28 having an axially driven piston 30 operably associated with the oscillatory motion transmitting shaft 26 through a yoke 32. As shown, the oscillatory motion transmitting shaft 26 has a bearing element 34 externally of the housing 22 whereby the yoke 32 can cooperate with the bearing element 34 to transmit axial movement to the oscillatory movement transmitting shaft 26.

Also as shown in FIG. 1, the disk engaging and disengaging means includes a radially extending thrust pin 36 integral with the oscillatory motion transmitting shaft 26 within the housing 22 for movement therewith. The radially extending thrust pin 36 is axially movable with the oscillatory motion transmitting shaft 26 from a first position where the disks 16 and 18 are engaged to a second position where the disks 16 and 18 are disengaged. In addition, the housing 22 includes a clutch polarizing portion generally designated 38 having an internal wall 40 with a restricted polarizing opening as at 42 adapted to admit the radially extending thrust pin 36 into the clutch polarizing portion 38 only in the single preselected angular orientation between the disks 16 and 18.

Referring to FIG. 2, the oscillatory motion imparting means includes a radially extending clutch lever 44 integral with the oscillatory motion transmitting shaft 26 externally of the housing 22. The radially extending clutch lever 44 is operatively associated with a cam 46 driven by the packer box 14, i.e., by a single binding line drive shaft which drives an associated drive shaft and cam of each of the packer boxes 14 in a binding line so as to maintain precise timing therebetween. More specifically, the radially extending clutch lever 44 is operatively associated with a cam follower 48 in any conventional fashion so as to impart oscillatory motion to one of the disks 16 through the oscillatory motion transmitting shaft 26.

Referring once again to FIG. 1, one of the disks 16 is a male disk and the other of the disks 18 is a female disk. As shown, the male disk 16 includes an engagement pin 50 and the female disk 18 includes an engagement opening 52. In this connection, the engagement opening 52 will receive the engagement pin 50 only in the single preselected angular orientation between the disks 16 and 18.

Figure 3:
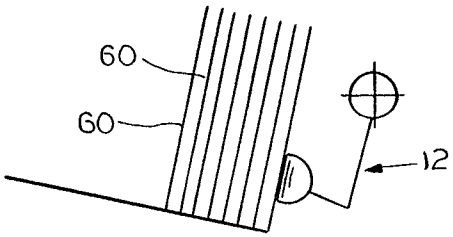
FIG. 3 is a schematic side elevational view illustrating a vacuum signature feeding device in a first position.

With the arrangement illustrated and described, the oscillatory motion transmitting means includes drive means in the form of the axial stud 24 for rotating the vacuum signature feeding device 12 when the male and female disks 16 and 18 are engaged. The drive means or stud 24 is operatively associated with the vacuum signature feeding device 12 in any conventional manner for imparting reciprocating rotational movement to the vacuum signature feeding device first in one direction as represented by the arrow 54 and then in the opposite direction as represented by the arrow 58. As shown, the clutch assembly 10 also includes spring means in the form of a spring 56 operably associated with the disk 18 and the vacuum signature feeding device 12 for biasing the vacuum signature feeding device 12 against the stack of signatures 60 when the male and female disks 16 and 18 are disengaged (see FIG. 3).

Referring specifically to FIGS. 1 and 2, the air actuator 28 may be pressurized by means of a conventional solenoid-operated air valve (not shown). When this occurs, the piston 30 drives the yoke 32 in a direction opposite the vacuum signature feeding device 12 which causes the oscillatory motion transmitting shaft 26 to be driven axially in the same direction by reason of the cooperation of the yoke 32 with the bearing 34. With the radially extending thrust pin 36 in alignment with the polarizing opening 42 in the inner wall 40 of the clutch polarizing portion 38, the engagement pin 50 is withdrawn from the engagement opening 52 thereby disengaging the disk 16 from the disk 18.

Referring to FIG. 1, it will be seen that the spring 56 is suitably disposed within a spring return housing 62. The spring return housing 62 also includes a spring lock 64 which allows the spring 56 to compress when the vacuum signature feeding device has rotated away from the stack of signatures 60, i.e., the spring 56 always tends to bias the vacuum signature feeding device 12 toward the signature stack. While illustrative of the preferred embodiment, it will be appreciated that other spring-type position maintaining arrangements can be utilized if desired.

When a binding line is under selective feeding operation, and the system calls for a signature 60 from a specific packer box 14, the solenoid-operated air valve will be energized to pressurize the air actuator 28 which will retract the axially driven piston 30. This, in turn, will cause the yoke 32 to act through the bearing 34 so as to cause the oscillatory motion transmitting shaft 26 to move axially while the cam 46 is acting on the cam follower 48 and, thus, on the clutch lever 44 thereby imparting oscillatory motion to the oscillatory motion transmitting shaft 26. As will be appreciated, the radially extending thrust pin 36 will be removed from the clutch polarizing portion 38 through the polarizing opening 42 in the internal wall 40 when the thrust pin 36 is in the preselected angular orientation whereby the engagement pin 50 will be inserted into the engagement opening 52.

After the engagement pin 50 is inserted into the engagement opening 52, oscillatory motion is transmitted from the male disk 16 to the female disk 18. It will be appreciated, of course, that oscillatory motion is continuously transmitted to the male disk 16 from the cam 46 regardless of whether the male and female disks 16 and 18 are engaged. Further, after the engagement pin 50 is inserted into the engagement opening 52, oscillatory motion is transmitted from the female disk 18 to the vacuum signature feeding device 12.

Figure 4:
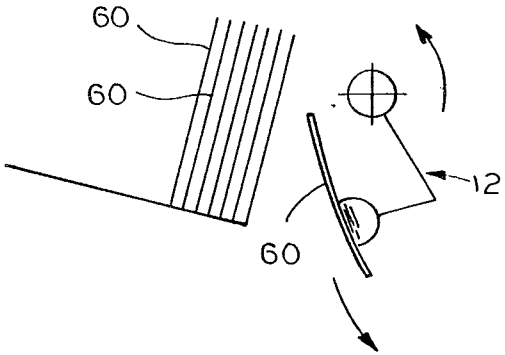
FIG. 4 is a schematic side elevational view illustrating a vacuum signature feeding device in a second position.

More specifically, oscillatory motion will be imparted from the cam 46 and cam follower 48 to the male disk 16, the female disk 18 and the vacuum signature feeding device 12 in the direction of the arrow 58 to position the vacuum signature feeding device 12 for pulling a signature 60 from the stack for delivery to a conveyor chain or the like. After the signature 60 has been delivered to the conveyor chain or the like, oscillatory motion will be imparted to the male disk 16 in the direction of the arrow 54 to return the vacuum signature feeding device 12 to the stack of signatures where the vacuum signature feeding device 12 can pull another signature 60 from the stack. (compare FIGS. 3 and 4).

In this connection, this pattern of reciprocating rotational movement will remain unless and until the selective feeding operation calls for no signature from the packer box 14. When this occurs, the solenoid-operated air valve will be energized to pressurize the air actuator 28 so as to move the axially driven piston 30 in the opposite direction to cause the engagement pin 50 to be withdrawn from the engagement opening 52 with the radially extending thrust pin 36 in alignment with the polarizing opening 42 whereby the thrust pin 36 can be retracted through the polarizing opening 42 and into the clutch polarizing portion 38 where the disks 16 and 18 will be disengaged. In this position, the male disk 16 will still have oscillatory motion imparted to it through the cam 46 and cam follower 48 although the female disk 18 will be held in a fixed position by the spring 56.

While there has been set forth a preferred embodiment of the invention, it will be appreciated that the invention is only to be limited by the true spirit and scope of the appended claims.

I claim:

1. A clutch assembly for a vacuum signature feeding device in a packer box, comprising:
   - a pair of disks disposed within a housing for selective driving engagement therebetween;
   - means for engaging and disengaging said disks only in a single preselected angular orientation therebetween;
   - means for imparting oscillatory motion to one of said disks when said disks are engaged; and
   - means for transmitting oscillatory motion from the other of said disks when said disks are engaged;
   - said oscillatory motion transmitting means being operatively associated with said vacuum signature feeding device.

2. The clutch assembly as defined in claim 1 wherein said oscillatory motion transmitting means includes drive means for rotating said vacuum signature feeding device first in one direction and then in the opposite direction.

3. The clutch assembly as defined in claim 1 including spring means operably associated with the other of said disks and said vacuum signature feeding device, said spring means including a spring biasing said vacuum signature feeding device toward a stack of signatures when said disks are disengaged.

4. The clutch assembly as defined in claim 1 wherein said disk engaging and disengaging means includes an oscillatory motion transmitting shaft extending axially from one end of said housing and means for transmitting axial movement to said oscillatory motion transmitting shaft.

5. The clutch assembly as defined in claim 4 wherein said axial movement transmitting means includes an air actuator having an axially driven piston, said axially driven piston being operably associated with said oscillatory motion transmitting shaft through a yoke.

6. The clutch assembly as defined in claim 5 wherein said oscillatory motion transmitting shaft has a bearing element externally of said housing, said yoke cooperating with said bearing element to transmit axial movement to said oscillatory movement transmitting shaft.

7. The clutch assembly as defined in claim 4 wherein said oscillatory motion imparting means includes a radially extending clutch lever integral with said oscillatory motion transmitting shaft externally of said housing.

8. The clutch assembly as defined in claim 7 wherein said radially extending clutch lever is operably associated with a cam driven by said packer box for imparting oscillatory motion to one of said disks through said oscillatory motion transmitting shaft.

9. The clutch assembly as defined in claim 4 wherein one of said disks is a male disk and the other of said disks is a female disk, said male disk being adapted to engage said female disk only in said single preselected angular orientation therebetween.

10. The clutch assembly as defined in claim 9 wherein said male disk includes an engagement pin and said female disk includes an engagement opening, said engagement opening receiving said engagement pin only in said single preselected angular orientation between said disks.

11. The clutch assembly as defined in claim 4 wherein said disk engaging and disengaging means further includes a radially extending thrust pin integral with said oscillatory motion transmitting shaft within said housing for movement therewith.

12. The clutch assembly as defined in claim 11 wherein said radially extending thrust pin is axially movable with said oscillatory motion transmitting shaft from a first position where said disks are engaged to a second position where said disks are disengaged.

13. The clutch assembly as defined in claim 12 wherein said housing includes a clutch polarizing portion having an internal wall with a polarizing opening adapted to allow said radially extending thrust pin to pass therethrough only in said single preselected angular orientation between said disks.

14. A clutch assembly for a vacuum signature feeding device in a packer box, comprising:

a pair of disks disposed within a bore in a housing for selective driving engagement therebetween;

means for engaging and disengaging said disks only in a single preselected angular orientation therebetween, said disk engaging and disengaging means including an axially extending oscillatory motion transmitting shaft, said oscillatory motion transmitting shaft extending from one end of said housing;

means for transmitting axial movement to said oscillatory motion transmitting shaft first in one direction then in the opposite direction to engage and disengage said disks; and means for imparting oscillatory motion to one of said pair of disks and means for transmitting oscillatory motion from the other of said pair of disks when said disks are engaged;

said oscillatory motion transmitting means being operatively associated with said vacuum signature feeding device and including drive means for rotating said vacuum signature feeding device first in one direction and then in the opposite direction.

15. The clutch assembly as defined in claim 14 including spring means operably associated with the other of said disks and said vacuum signature feeding device, said spring means including a spring biasing said vacuum signature feeding device toward a stack of signatures.

16. The clutch assembly as defined in claim 14 wherein said axial movement transmitting means includes an air actuator having an axially driven piston, said axially driven piston being operably associated with said oscillatory motion transmitting shaft through a yoke.

17. The clutch assembly as defined in claim 16 wherein said oscillatory motion transmitting shaft has a bearing element externally of said housing, said yoke cooperating with said bearing element to transmit axial movement to said oscillatory movement transmitting shaft.

18. The clutch assembly as defined in claim 14 wherein said oscillatory motion imparting means includes a radially extending clutch lever integral with said oscillatory motion transmitting shaft externally of said housing.

19. The clutch assembly as defined in claim 18 wherein said radially extending clutch lever is operably associated with a cam driven by said packer box for imparting oscillatory motion to one of said disks through said oscillatory motion transmitting shaft.

20. The clutch assembly as defined in claim 14 wherein one of said disks is a male disk and the other of said disks is a female disk, said male disk being adapted to engage said female disk only in said single preselected angular orientation therebetween.

21. The clutch assembly as defined in claim 20 wherein said male disk includes an engagement pin and said female disk includes an engagement opening, said engagement opening receiving said engagement pin only in said single preselected angular orientation between said disks.

22. The clutch assembly as defined in claim 14 wherein said disk engaging and disengaging means further includes a radially extending thrust pin integral with said oscillatory motion transmitting shaft within said housing for movement therewith.

23. The clutch assembly as defined in claim 22 wherein said radially extending thrust pin is axially movable with said oscillatory motion transmitting shaft from a first position where said disks are engaged to a second position where said disks are disengaged.

24. The clutch assembly as defined in claim 23 wherein said housing includes a clutch polarizing portion having an internal wall with a polarizing opening adapted to allow said radially extending thrust pin to pass therethrough only in said single preselected angular orientation between said disks.

25. A clutch assembly for a vacuum signature feeding device in a packer box, comprising:

a pair of disks disposed within a bore in a housing for selective driving engagement therebetween;

means for engaging and disengaging said disks only in a single preselected angular orientation therebetween, said disk engaging and disengaging means being selectively operable and including an axially extending oscillatory motion transmitting shaft, said oscillatory motion transmitting shaft extending from one end of said housing;

said disk engaging and disengaging means further including a radially extending thrust pin integral with said oscillatory motion transmitting shaft within said housing for movement therewith, said radially extending thrust pin being axially movable with said oscillatory motion transmitting shaft from a first position where said disks are engaged to a second position where said disks are disengaged, said housing including a clutch polarizing portion having an internal wall with a polarizing opening adapted to allow said radially extending thrust pin to pass therethrough only in said single preselected angular orientation between said disks;

means for transmitting axial movement to said oscillatory motion transmitting shaft first in one direction then in the opposite direction to engage and disengage said disks; and means for imparting oscillatory motion to one of said pair of disks and means for transmitting oscillatory motion from the other of said pair of disks when said disks are engaged;

said oscillatory motion transmitting means being operatively associated with said vacuum signature feeding device and including drive means for rotating said vacuum signature feeding device first in one direction and then in the opposite direction;

whereby reciprocating movement of said vacuum signature feeding device can be selectively interrupted with said vacuum signature feeding device in a preselected position without vacuum interruption.

26. The clutch assembly as defined in claim 25 wherein said oscillatory motion imparting means includes a radially extending clutch lever integral with said oscillatory motion transmitting shaft externally of said housing.

27. The clutch assembly as defined in claim 26 wherein said radially extending clutch lever is operably associated with a cam driven by said packer box for imparting oscillatory motion to one of said disks through said oscillatory motion transmitting shaft.

28. The clutch assembly as defined in claim 27 wherein one of said disks is a male disk and the other of said disks is a female disk, said male disk being adapted to engage said female disk only in said single preselected angular orientation therebetween.

29. The clutch assembly as defined in claim 28 wherein said male disk includes an engagement pin and said female disk includes an engagement opening, said engagement opening receiving said engagement pin only in said single preselected angular orientation between said disks.

30. The clutch assembly as defined in claim 29 including spring means operably associated with the other of said disks and said vacuum signature feeding device, said spring means including a spring biasing said vacuum signature feeding device toward a stack of signatures.

31. The clutch assembly as defined in claim 30 wherein said axial movement transmitting means includes an air actuator having an axially driven piston, said axially driven piston being operably associated with said oscillatory motion transmitting shaft through a yoke.

32. The clutch assembly as defined in claim 31 wherein said oscillatory motion transmitting shaft has a bearing element externally of said housing, said yoke cooperating with said bearing element to transmit axial movement to said oscillatory movement transmitting shaft.

* * * * *